US007346947B2

(12) United States Patent
Kruger, Jr.

(10) Patent No.: US 7,346,947 B2
(45) **Date of Patent: *Mar. 25, 2008**

(54) PILLOW WITH CENTRAL AREA HAVING LOWER FILL VOLUME

(75) Inventor: John F. Kruger, Jr., Clyde Hill, WA (US)

(73) Assignee: Pacific Coast Feather Company, Seattle, WA (US)

( * ) Notice: Subject to any disclaimer, the term of this patent is extended or adjusted under 35 U.S.C. 154(b) by 194 days.

This patent is subject to a terminal disclaimer.

(21) Appl. No.: 11/192,601

(22) Filed: Jul. 29, 2005

(65) Prior Publication Data

US 2005/0257321 A1 Nov. 24, 2005

Related U.S. Application Data

(63) Continuation-in-part of application No. 10/685,884, filed on Oct. 14, 2003, now Pat. No. 6,931,682.

(51) Int. Cl.
*A47G 9/00* (2006.01)

(52) U.S. Cl. ..... 5/645; 5/636

(58) Field of Classification Search ..... 5/636, 5/637, 639, 644, 645
See application file for complete search history.

(56) References Cited

U.S. PATENT DOCUMENTS 2,805,428 A * 9/1957 Buchman ..... 5/645
4,513,462 A * 4/1985 Thomas ..... 5/645
5,088,141 A * 2/1992 Meyer et al. ..... 5/636
5,363,524 A * 11/1994 Lang ..... 5/640
5,557,816 A * 9/1996 Pedersen et al. ..... 5/645
5,708,998 A * 1/1998 Torbik ..... 5/636
6,931,682 B2 * 8/2005 Kruger, Jr. ..... 5/645

FOREIGN PATENT DOCUMENTS

EP 0069079 A2 * 6/1983

* cited by examiner

*Primary Examiner*—Michael Trettel
(74) *Attorney, Agent, or Firm*—Jensen & Puntigam, P.S.

(57) ABSTRACT

The pillow comprises four substantially identical fabric sections arranged in registry and secured together around the peripheries thereof. A line of stitching connects the middle two layers, defining a circular area in the center of the pillow. The pillow is filled between the middle two layers from the line of stitching to the peripheral edges of the fabric sections. Filling is also present between the upper fabric section and one of the middle fabric sections, and between the lower fabric layers and the other middle fabric section, resulting in a pillow which has less filling in the center thereof.

5 Claims, 4 Drawing Sheets

PILLOW WITH CENTRAL AREA HAVING LOWER FILL VOLUME

PRIOR APPLICATION

This is a continuation-in-part application of U.S. patent application Ser. No. 10/685,884 filed Oct. 14, 2003 now U.S Pat. No. 6,931,682.

TECHNICAL FIELD

This invention relates generally to pillows, and more specifically concerns a pillow with a central portion having a lower fill volume than the remaining portions thereof.

BACKGROUND OF THE INVENTION

It is well known that bed pillows are available in a large variety of sizes and configurations. Some pillows have a particular configuration for specialized support or for other particular purposes. However, a primary objective of most, if not all, pillows is comfort for the user. Some pillows are known to have a portion of the pillow with less fill than other portions. Such pillows are shown in U.S. Pat. No. 5,168,590 to O'Sullivan and U.S. Pat. No. 4,788,728 to Lake, both of which show a pillow with a central area with less fill. U.S. Pat. No. 5,557,816 to Pedersen teaches a pillow with an internal baffle structure to permit various filling arrangements, including more fill per volume in some portions than in others.

In some cases, it is desirable that the pillow provide a support or cradling capability for the head of the user. While the '509 and '728 patents attempt to address that need, they may not be particularly comfortable, because of their particular construction and fill arrangements.

It is thus desirable to have a pillow that is capable of providing good, comfortable support with a central area having less fill than the remainder of the pillow.

SUMMARY OF THE INVENTION

Accordingly, the present invention is a pillow which comprises four substantially identical fabric sections, arranged in registry and secured together around the peripheries thereof; a closed line of securement between the middle two of the four fabric sections in a center area of the pillow, defining an area which is substantially smaller than the diameter of a user's head but large enough to provide a cradle effect therefor; and filling between the middle two fabric sections, between the line of securement and the peripheral edges of the middle two fabric sections, with no or relatively little filling within an area defined by the line of securement, as well as filling between an upper fabric section and one middle fabric section and filling between a lower fabric section and the other middle fabric section over the entire area of the pillow, wherein the relative lack of filling between the middle two fabric sections within the area defined by the line of securement compared to the remainder of the pillow results in a small shallow area in the center of the pillow for cradling the user's head.

BEST MODE FOR CARRYING OUT THE INVENTION

Figure 1:
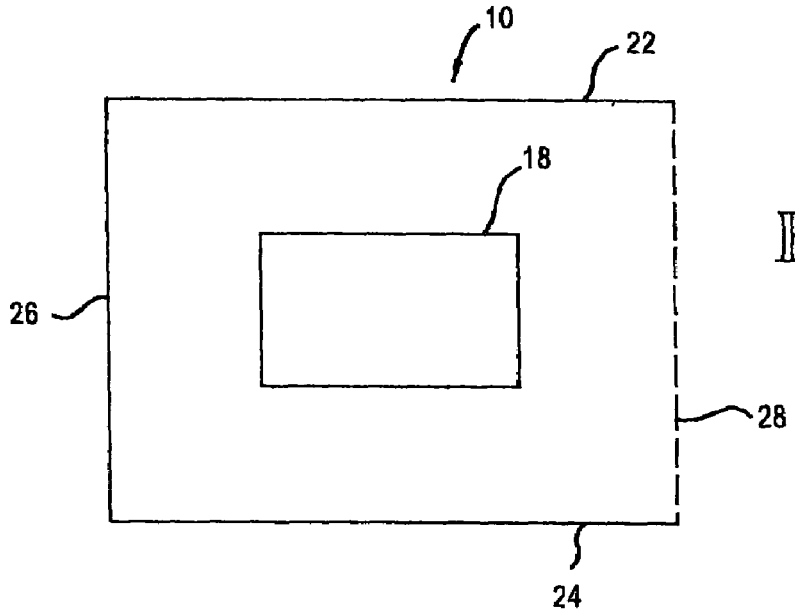
FIG. 1 is a top view of one embodiment of the pillow of the present invention.

FIG. 1 shows one embodiment of the pillow of the present invention. The pillow, shown generally at 10 in FIGS. 1 and 3, comprises four identical fabric layers 12-15. In the embodiment shown, for a standard size pillow, each fabric layer is 26 inches long and 20 inches wide. This can be varied, depending upon the desired size of the pillow. The fabric layers are, in one example, 230 thread count white cotton. Other thread count fabrics can be used.

Figure 2:
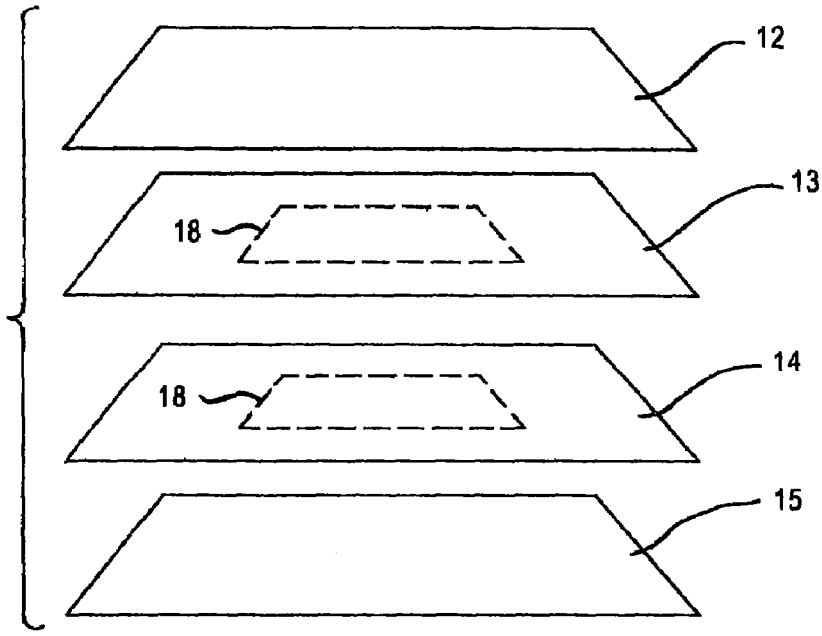
FIG. 2 is an exploded view showing the individual fabric sections of the pillow of FIG. 1.
Figure 3:
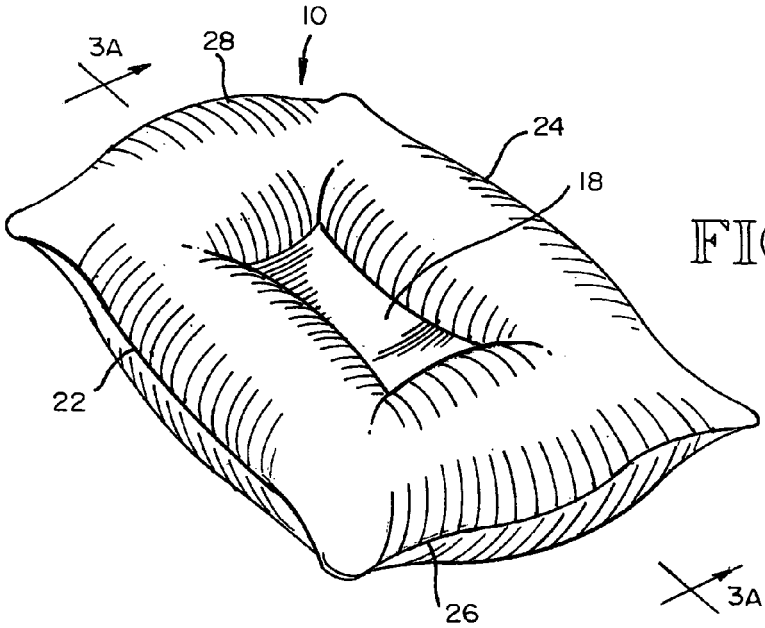
FIGS. 3 and 3A are perspective and cross-sectional views showing the completed pillow of FIGS. 1 and 2.
Figure 3A:
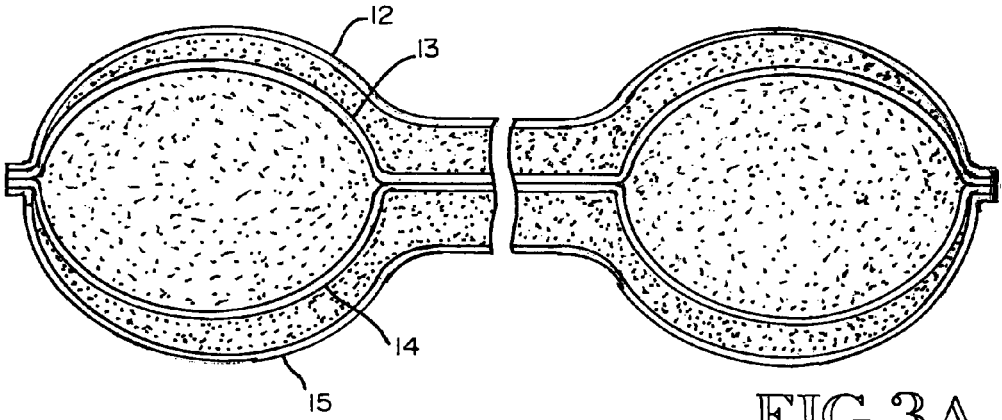

In a first construction step of the pillow of FIGS. 1-3, the middle two fabric layers 13 and 14 are positioned in registry and sewn together in a rectangular pattern in the center area thereof. In the embodiment shown, this rectangular portion 18 is 8 inches long by 4 inches wide. The two fabric layers could also be attached by other means. With the above dimensions of portion 18, there remains a distance of 8 inches between rectangular portion 18 and longitudinal side edges 22 and 24, and 9 inches between the rectangular portion 18 and end edges 26 and 28. These dimensions, including the dimensions of the rectangular portion, however, can be changed. The size of the rectangular portion, however, should be such as to comfortably receive the head of a user.

In the next step, the four fabric layers 12-15, all in registry, are sewn together along longitudinal side edges 22 and 24 and end edge 26, such as by double needle or serge stitching. This leaves end edge 28 open to permit filling of the pillow.

In the filling step, the filling, which can be either natural filling, such as down or feathers, or synthetic filling such as polyester or foam or other filling, or a combination thereof, is blown into the space between the middle two fabric layers 13 and 14 from the outline of the rectangular portion to the peripheral edges thereof. There is little or no filling in the rectangular portion 18. This creates a "picture frame" configuration around central rectangular portion 18. Typically for the size of pillow described, a range of 16-20 ounces of down filling will be blown into the pillow between fabric layers 13 and 14.

In the next step, filling is blown in between the upper fabric layer 12 and middle fabric layer 13, and similarly between lower fabric layer 15 and the other middle fabric layer 14. This filling can be either the same as the fill between layers 13 and 14, or it could be different, such as synthetic fill instead of natural fill or vice versa. Further, the fill could be different between upper layer 12 and middle layer 13, relative to that between lower layer 15 and middle layer 14. Each fill amount (between layers 12 and 13 and between layers 14 and 15) will typically be in the range of 3-8 ounces. Still further, the fill amounts could be the same, or they could be different, as selected by the manufacturer for a particular commercial arrangement.

The four layers at end edge 28 are then sewn together, completing the pillow. In this present construction, there is substantially no or little filling within the rectangle portion 18 between the two middle fabric sections 13 and 14. However, there is fill throughout the entire pillow area between upper fabric layer 12 and middle fabric layer 13 and between middle fabric layer 14 and lower fabric layer 15. This results in a pillow which has a central area which has less filling and thus receives the head of a user, while at the same time having some fill therein for comfort and support. The pillow provides support for the neck while allowing the head to sink in the middle area.

Figure 6:
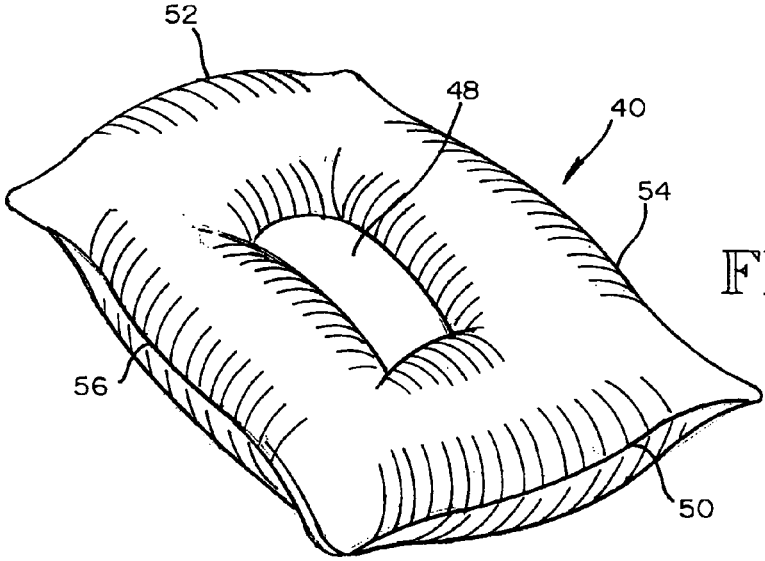
FIG. 6 is a perspective view showing the completed pillow of FIGS. 4 and 5.
Figure 4:
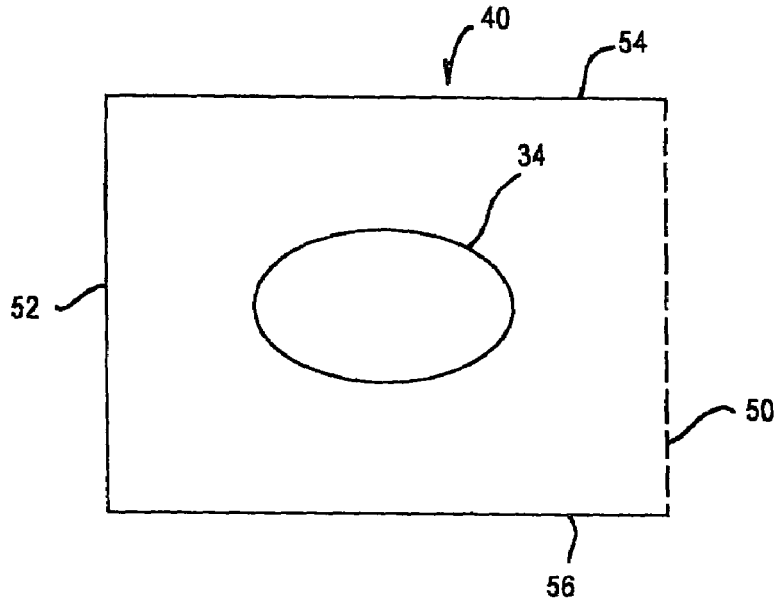
FIG. 4 is a top view of a second embodiment of the pillow of the present invention.
Figure 5:
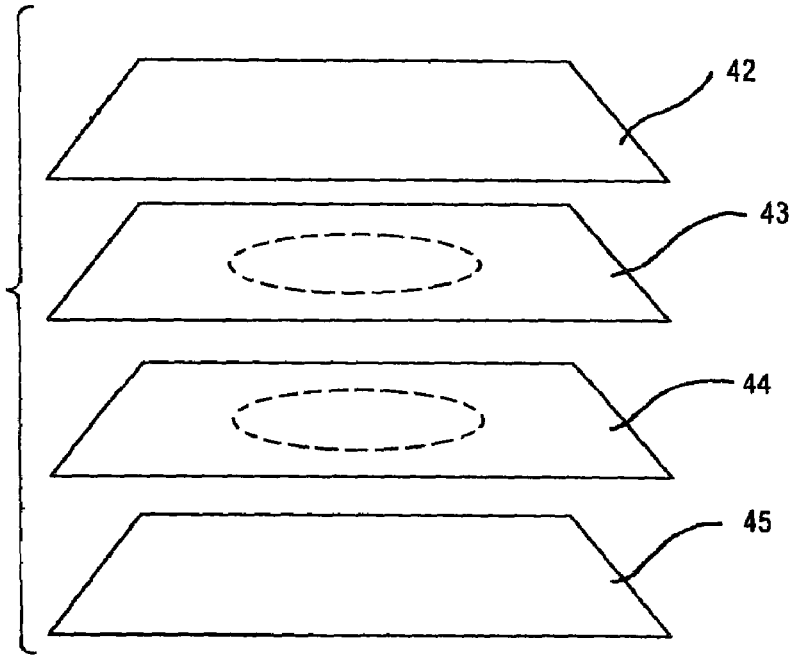
FIG. 5 is an exploded view showing the individual fabric sections of the pillow of FIG. 4.

FIGS. 4-6 disclose a similar pillow 40 for a king-size configuration. Pillow 40 also includes four identical fabric sections 42-45, in registry. In this case, the length of the pillow is 36 inches, while the width of the pillow is 20 inches. The area 48 in the center portion of the pillow, instead of being a rectangle such as in FIGS. 1-3, is an oval, with dimensions of 8 inches in one direction and 5 inches in the other direction, leaving 14 inches between the oval portion 48 and the respective end edges 50, 52 of the pillow, and 7½ inches between oval portion 48 and the respective longitudinal edges 54, 56 of the pillow. Again, these dimensions can certainly be varied.

The construction of the pillow of FIGS. 4-6 is basically the same as for the pillow of FIGS. 1-3, with the stitching of the oval portion 40 being accomplished first for fabric layers 43, 44, followed by the stitching of the four fabric layers 42-45 along the two longitudinal edges 54, 56 and one end edge 50. Filling is then blown into the area between the two middle fabric sections, between the line of stitching defining the oval portion and the peripheral edges of the fabric sections, but typically not within the oval 40, followed by filling blown in between the fabric sections 42 and 43 and fabric section 44 and 45, respectively. A small amount of filling could be blown in between the two middle fabric sections.

While the central area in the above embodiments has been shown to be rectangular or oval, it could be other shapes, such as a circle, a square or even an irregular pattern.

Figure 7:
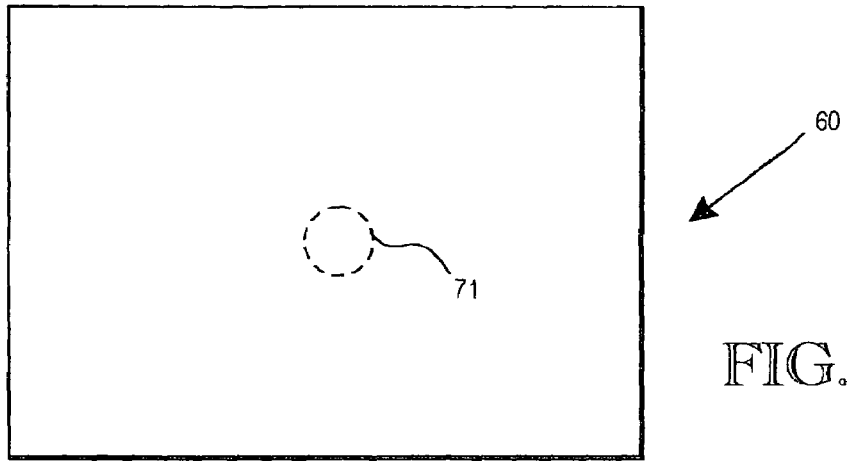
FIGS. 7-8 show another embodiment of the present invention.
Figure 8:
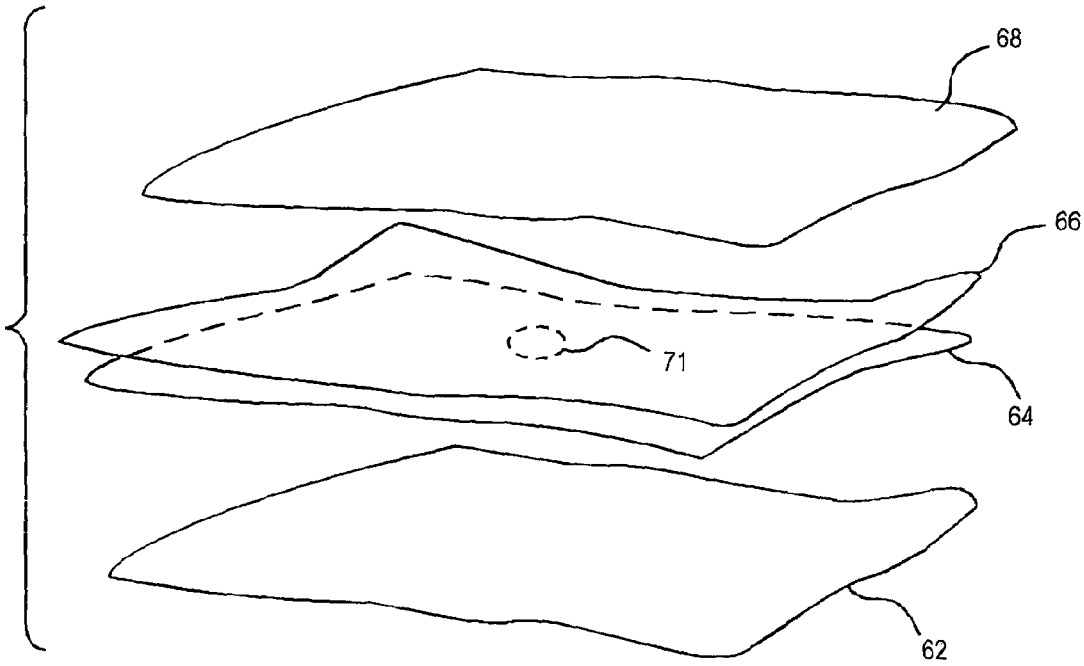

Referring now to FIGS. 7 and 8, in this embodiment, the shallow central area of the pillow, which has a lower fill volume, is quite small compared to the overall size of the pillow, significantly smaller than the shallow central area in the embodiments described above. At the center of the pillow 60, which comprises four identical, successive fabric layers 62, 64, 66 and 68, a line of stitching 70, defining a central area 71 in the form of a circle, connects the inner two fabric sections 62 and 64. The line of stitching 70 is not sewn through the outer two fabric layers 66 and 68. In the embodiment shown, the circle is approximately 1.5 inches in diameter. This small circle creates a small, divot-like depression for the user's head to sink into, with a cradling effect.

The size of the central area can be varied to some extent, i.e. within a range of 1 to 3 inches. Also, the configuration of the central area 71 can also be varied to some extent, such that it could be more like, for example, a square or an oval or an irregular pattern, as long as it provides a cradle effect for the head of a user.

Although a preferred embodiment of the invention has been described for purposes of illustration, it should be understood that various changes, modification and substitutions may be incorporated in the embodiment without departing from the spirit of the invention which is defined by the claims which follow.

What is claimed:

1. A pillow, comprising:

four substantially identical fabric sections, arranged in registry and secured together around the peripheries thereof;

a line of securement between the middle two of the four fabric sections in a center area of the pillow, defining an area which is substantially smaller than the diameter of a user's head, but large enough to provide a cradle effect therefor, leaving a boundary region for filling between the line of securement and the respective peripheral edges of the two fabric sections; and filling positioned between the middle two fabric sections, between the line of securement and the peripheral edges thereof, with relatively little or no filling in the center area between the middle two fabric sections, as well as filling positioned between an upper fabric section and one middle fabric section and filling between a lower fabric section and the other middle fabric section over the entire area of the pillow, wherein the pillow thereby has a shallow area in the center of the pillow, resulting from the relative lack of filling between the middle two fabric sections in the center area compared to the remainder of the pillow.

2. The pillow of claim 1, wherein the line of securement defines approximately a circle.

3. The pillow of claim 2, wherein the diameter of the line of securement is within a range of 1-3 inches.

4. The pillow of claim 3, wherein the diameter of the line of securement is approximately 1.5 inches.

5. The pillow of claim 1, wherein the longest edge-to-edge dimension of the line of securement is within the range of 1-3 inches.

* * * * *